US009160068B2

(12) United States Patent
Greetis et al.

(10) Patent No.: US 9,160,068 B2
(45) Date of Patent: Oct. 13, 2015

(54) SYSTEMS AND METHODS FOR ANTENNA ARRANGEMENTS IN AN ELECTRONIC DEVICE

(71) Applicant: Google Technology Holdings LLC, Mountain View, CA (US)

(72) Inventors: Lynn M Greetis, Mundelein, IL (US); Soo Won Hong, Vernon Hills, IL (US); Benjamin O. White, Crystal Lake, IL (US)

(73) Assignee: Google Technology Holdings LLC, Mountain View, CA (US)

( * ) Notice: Subject to any disclaimer, the term of this patent is extended or adjusted under 35 U.S.C. 154(b) by 229 days.

(21) Appl. No.: 13/890,425

(22) Filed: May 9, 2013

(65) Prior Publication Data

US 2014/0333486 A1 Nov. 13, 2014

(51) Int. Cl.

*H01Q 1/24* (2006.01)
*H01Q 1/52* (2006.01)
*H01Q 21/28* (2006.01)

(52) U.S. Cl.

CPC ..... *H01Q 1/52* (2013.01); *H01Q 1/243* (2013.01); *H01Q 21/28* (2013.01); *Y10T 29/49018* (2015.01)

(58) Field of Classification Search

USPC ..... 343/700 MS, 702
See application file for complete search history.

(56) References Cited

U.S. PATENT DOCUMENTS 8,270,914 B2 9/2012 Pascolini et al.
8,310,825 B2 * 11/2012 Schlesener et al. ..... 361/679.27
8,350,764 B2 1/2013 Rao et al.
8,907,853 B2 * 12/2014 Ying ..... 343/702
2009/0128425 A1 5/2009 Kim et al.
2010/0304785 A1 12/2010 Marlett et al.
2011/0215971 A1 9/2011 Rao (Continued)

FOREIGN PATENT DOCUMENTS

EP 2237129 A2 10/2010
EP 2690705 A1 1/2014
WO 2007/039667 A1 4/2007

(Continued)

OTHER PUBLICATIONS

Wikipedia, "UMTS Frequency Bands", en.wikipedia.org/wiki/UMTS_frequency_bands, accessed Mar. 28, 2013, 5 pages.

(Continued)

*Primary Examiner* — Tan Ho

(57) ABSTRACT

Systems and methods are provided for arranging antennas in an electronic device (200). According to one aspect, the electronic device includes a housing (202) and an antenna arrangement. The antenna arrangement includes a first volume (206) positioned adjacent to an edge (212) of the housing, the first volume enclosing a first antenna structure (230) shaped substantially according to a geometry of the edge; a second volume (208) positioned adjacent to a first corner (216) of an opposing edge (214) of the housing, the second volume including a second antenna structure (232) shaped substantially according to a geometry of the first corner; and a third volume (210) adjacent to a second corner (218) of the opposing edge, the third volume including a third antenna structure (234) shaped substantially according to a geometry of the second corner, wherein the first, second, and third volumes do not overlap and are discontinuous.

23 Claims, 9 Drawing Sheets

(56) References Cited

U.S. PATENT DOCUMENTS

| | | | | |
|---|---|---|---|---|
| 2014/0218244 | A1* | 8/2014 | Chang et al. | 343/702 |
| 2015/0022401 | A1* | 1/2015 | Gavilan et al. | 343/702 |

FOREIGN PATENT DOCUMENTS

| | | | |
|---|---|---|---|
| WO | 2011/106899 | A1 | 9/2011 |
| WO | 2012/048741 | A1 | 4/2012 |
| WO | 2014/035599 | A1 | 3/2014 |
| WO | 2014/182504 | A1 | 11/2014 |

OTHER PUBLICATIONS

Wikipedia, "List of LTE Networks", en.wikipedia.org/wiki/List_of_LTE_networks, accessed Mar. 28, 2013, 11 pages.

Jin Teng, "Mobile Handset Cellular Network", http://www.cse.ohio-state.edu/~xuan/courses/694/694_CELLULAR_NETWORK.ppt, accessed Mar. 9, 2013, 64 pages.

International Search Report and Written Opinion for PCT Patent Application No. PCT/US2014/035885, mailed on Aug. 8, 2014, 11 pages.

* cited by examiner

SYSTEMS AND METHODS FOR ANTENNA ARRANGEMENTS IN AN ELECTRONIC DEVICE

FIELD

This application generally relates to wireless communications devices. In particular, the application relates to platforms and techniques for arranging antenna structures in wireless communications devices.

BACKGROUND

Wireless communications devices, including mobile telephones and other portable radio communication devices, can include internal, embedded antennas or external, protruding antennas. Internal antennas have become increasingly popular at least because of their small size, light weight, and aesthetic advantages (e.g., allowing the device to have a sleek outer design). However, the arrangement of antennas within, for example, a mobile phone can be constrained at least due to the limited space that is available for antenna structures. For example, when mounted inside a mobile device, the antennas are often subject to problematic amounts of electromagnetic interference from other metallic or conductive objects within the device, particularly from a ground plane included within the device housing. To minimize such performance-abating interference, the antenna volume (e.g., a three-dimensional space inside the device that can be occupied by an antenna structure) can include "dead space" or a "keepout" clearance to set the antenna structure a requisite distance apart from nearby conductive element(s). In at least this way, a given antenna structure can occupy more space or volume within the mobile phone than just the physical geometry of the antenna structure.

Moreover, the growing demand for connectivity in an increasingly mobile world, and for high speed, high data rate wireless communications, has resulted in mobile communications devices that have an increasing number of antennas, covering multiple frequency bands and both cellular radio access technologies (RATs) and non-cellular RATs (e.g., Bluetooth®, Near Field Communication (NFC), Wireless Local Area Network (WLAN, a.k.a. WiFi), Wireless Metropolitan Area Networks (WMAN, a.k.a. WiMax), Radio Frequency Identification (RFID), Global Positioning System (GPS), etc.). As a result, the internal antenna volume within a mobile phone is often shared by several antennas situated in close proximity, creating antenna design challenges related to isolation, efficiency, and bandwidth.

Antenna design can be further complicated by the need for interoperability between multiple, cellular RATs as existing technologies evolve, or new technologies emerge in parallel to the existing RATs. For example, GSM (Global System for Mobile Communications), EDGE (Enhanced Data Rates for GSM Evolution), UMTS (Universal Mobile Telecommunications System), and LTE (Long Term Evolution) can be considered evolutions of the same platform and are colloquially referred to as 2G, 2.5G, 3G, and 4G technologies, respectively. CDMA (Code Division Multiple Access) can be considered a competing 3G technology that blends into LTE's 4G technology. These different RATs, whether GSM-based or CDMA-based, may require different circuitry components within a printed circuit board of the mobile device. Further, each of the RATs operates within different frequency bands, and each frequency band may be assigned to specific regions of the world and/or specific wireless communications carriers. As a result, global mobile device manufacturers often create carrier, region, and/or RAT-specific versions or variants of their mobile devices to have a presence in various markets around the world.

BRIEF DESCRIPTION OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed embodiments, and explain various principles and ad vantages of those embodiments.

DETAILED DESCRIPTION

Figure 1:
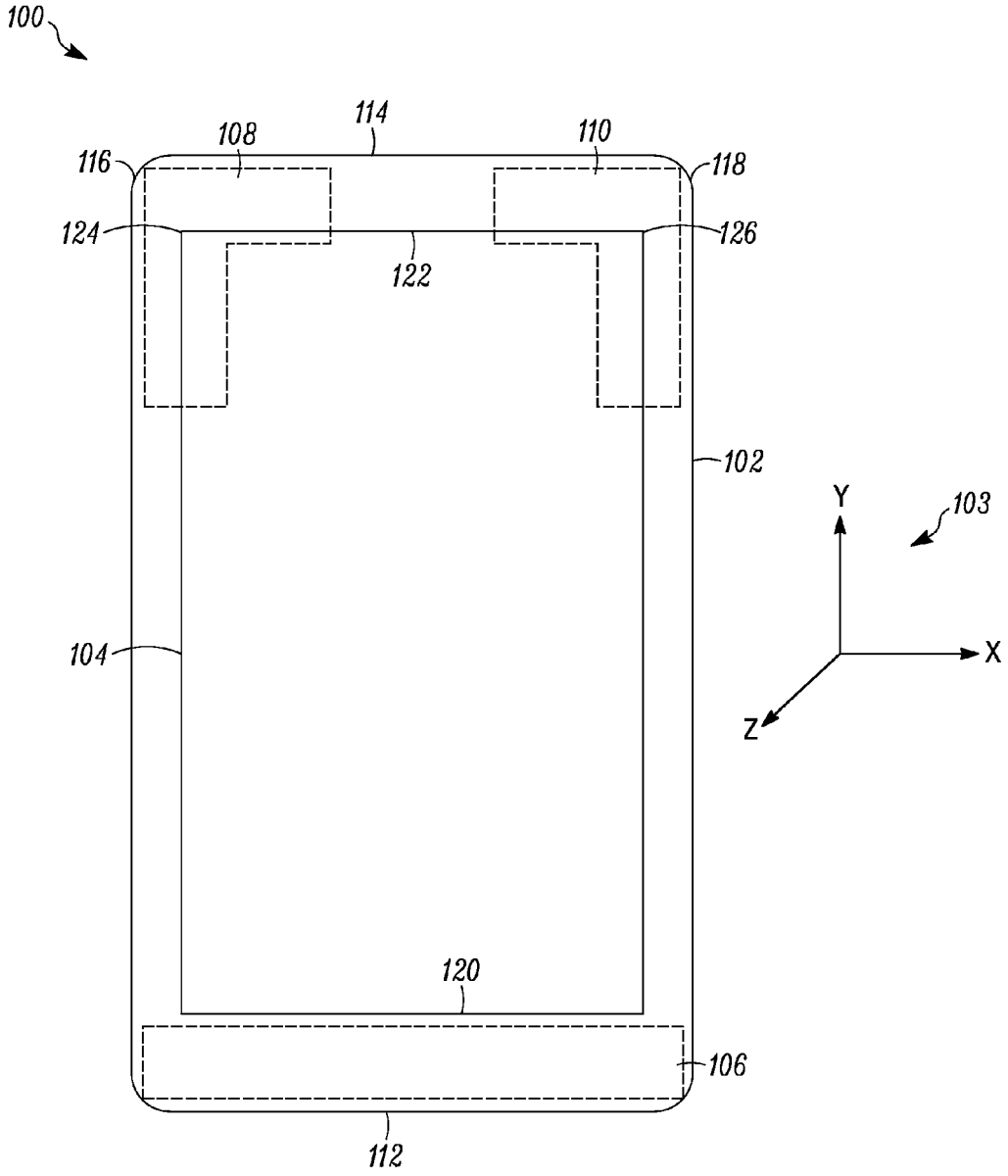
FIG. 1 illustrates an example front view of an electronic device including an antenna arrangement in accordance with some embodiments.

Systems and methods disclosed herein provide a consistent approach to arranging antenna structures in electronic devices that are configured to transmit and receive signals over a plurality of frequency bands. According to one aspect, the same general arrangement or layout of antenna structures may be capable of supporting different combinations of wireless communications standards with consistent antenna performance. For example, each of these antenna structures may be tuned or optimized to different frequency bands (or subbands) that are supported by one or more of the wireless communication standards. In one embodiment, the antenna arrangement may be configured to operate on frequencies at or around at least four of the following frequency bands: 700 MHz, 850 MHz, 900 MHz, 1575 MHz, 1700 MHz, 1800 MHz, 1900 MHz, 2100 MHz, or 2400 MHz. Such antenna banding flexibility may be achieved, at least partially, by arranging the components within the electronic device so that the available antenna volume is maximized.

More specifically, according to one aspect, the antenna arrangement can include at least three non-overlapping volumes that are positioned adjacent to pre-selected edges of the housing. For example, a first volume can be positioned adjacent to a first edge of the housing, a second volume can be positioned adjacent to a first corner of a second, opposing edge of the housing, and a third volume can be positioned adjacent to a second corner of the opposing edge of the housing. In one embodiment, these volumes can correspond to ungrounded portions of a printed circuit board within the housing. Further, each of the first, second, and third volumes can include a separate antenna structure that has a geometry similar to that of the corresponding housing edge. For example, the first volume can enclose a first antenna structure that is shaped substantially according to a geometry of the first edge, the second volume can enclose a second antenna structure that is shaped substantially according to a geometry of the first corner, and the third volume can enclose a third antenna structure that is shaped substantially according to a geometry of the second corner. According to embodiments, a geometry of the first volume may be different from geometries of the second and third volumes, and the geometry of the second volume may be a mirror image of the geometry of the third volume.

As used herein, the term "wireless communications standards" includes any type of radio access technology (RAT), including wireless wide area networks (e.g., GSM, EDGE, CDMA, WCDMA (Wideband Code Division Multiple Access), TD-SCDMA (Time Division Synchronous CDMA), HSPA (High Speed Packet Access), UMTS, LTE, GPS, etc.), wireless local area networks (e.g., WMAN or WiFi, etc.), personal area networks (e.g., Bluetooth, NFC, RFID, ZigBee, UWB (Ultra Wide Band), etc.), etc. The range of frequencies covered by each RAT system varies widely, can be specific to a country or region, and in some cases, overlaps across systems.

For example, the GSM digital system currently operates in frequencies between 850 megahertz (MHz) and 1900 MHz. More specifically, the GSM system covers a frequency band around 850 MHz that is known as GSM850 or GSM800 and can include, e.g., 824-849 MHz on the uplink (UL) and 869-894 on the downlink (DL). The GSM system also covers a frequency band around 900 MHz that is known as GSM900 and can include, e.g., 890-915 MHz UL and 935-960 MHz DL. Additionally, the GSM system covers a frequency band around 1800 MHz that is known as GSM1800 and can include, e.g., 1710-1785 MHz UL and 1805-1880 MHz DL. Further, the GSM system covers a frequency band around 1900 MHz that is known as GSM1900 and can include, e.g., 1850-1910 MHz UL and 1930-1990 MHz DL. GSM900 and GSM1800 are used in most parts of the world, including Europe, Middle East, Africa, Australia, Oceania, and most of Asia. Different countries within South and Central America use different combinations of the GSM bands. GSM 850 and GSM 1900 are used in Canada and the United States. The GSM system includes other, less commonly used frequency bands that are not listed herein for the sake of brevity. EDGE adds a packet-data infrastructure to GSM and is fully backwards-compatible with the older GSM network. Thus, EDGE can operate within the existing GSM frequency bands.

UMTS utilizes the same core network as GSM but employs WCDMA technology. In general, the UMTS system operates in frequencies between 700 MHz and 2100 MHz. The specific frequency bands allocated to UMTS are divided into numbered operating bands, which are assigned to specific regions of the world. Four of these operating bands, commonly known as WCDMA850 (Band 5), WCDMA900 (Band 8), DCS1800 (Band 3), and WCDMA1900 (Band 2), at least generally overlap with the GSM850, GSM900, GSM1800, and GSM1900 frequency bands, respectively. Operating band 4, commonly known as WCDMA1700 or AWS (Advanced Wireless Services), includes frequencies around 1700 MHz on the uplink (UL) (e.g., 1710-1755 MHz UL) and 2100 MHz on the downlink (DL) (e.g., 2110-2155 MHz). Operating band 1, commonly known as WCDMA2100, includes frequencies around 2100 MHz (e.g., 1920-1980 MHz UL and 2110-2170 MHz DL). Operating band 7, commonly known as IMT-E, includes frequencies around 2600 MHz (e.g., 2500-2570 MHz UL and 2620-2690 MHz DL). Operating bands 12, 13, and 17, commonly known as SMH, include frequencies around 700 MHz (e.g., 698-716 MHz UL and 728-746 MHz DL, 777-787 MHz UL and 746-756 MHz DL, and 788-798 MHz UL and 758-768 MHz DL, respectively). Operating band 11 includes frequencies around 1500 MHz (e.g., 1428-1448 MHz UL and 1476-1496 MHz DL). Operating bands 19 and 20 include frequencies around 800 MHz (e.g., 832-842 MHz UL and 877-887 MHz DL, and 832-862 MHz UL and 791-821 MHz DL, respectively). UMTS covers additional operating bands that are not listed here for the sake of brevity.

The TD-SCDMA system is part of the UMTS network, particularly in China, and is an alternative to WCDMA. TD-SCDMA is also known as UMTSA-TDD or IMT 2000 Time-Division (IMT-TD). The TD-SCDMA network in China currently operates in frequency bands at or around 1900 MHz or Band 39 (e.g., 1880 MHz to 1920 MHz) and 2000 MHz or Band 34 (e.g., 2010 MHz to 2025 MHz). Other regions of the world utilize other TD-SCDMA bands that are not listed here for the sake of brevity.

LTE is designed to coexist with the UMTS and GSM systems and therefore, supports both future and legacy (existing) frequency bands, including the operating bands listed above for the GSM and UMTS systems. Accordingly, the LTE system currently operates in frequencies between 700 MHz and 2600 MHz. More specifically, the frequency bands covered by LTE in different regions of the world include: 700 MHz or Bands 12, 13, or 17, used in the United States and Canada; 800 MHz or Band 20, used in Europe; 850 MHz or Band 5, used in the Americas, parts of Asia, and Australia; 900 MHz or Band 8, used in parts of South America and Asia and in South Africa, AWS or Band 4, used in the United States, Canada, and Chile; 1800 MHz or Band 3, used in Europe, Asia, and Oceania; 1900 MHz or Band 2, used in North America and parts of South America; 2100 MHz or Band 1, used in Brazil, Europe, Asia, Africa, and Oceania; 2500 MHz or Band 41, used in South America; and 2600 MHz or Bands 7 or 38, used (or projected for use) in North America and parts of South America, Asia, and Europe.

The CDMA system currently operates in frequency bands between 850 MHz and 2100 MHz. More specifically, the frequency bands covered by CDMA in different regions of the world include: bands BC0 and BC10, both of which cover frequencies at or around 850 MHz; band BC1, which covers frequencies at or around 1900 MHz band; and BC15, which covers frequencies at or around 1700 MHz UL and 2100 MHz DL. Further, the CDMA system currently provides coverage throughout North America and in Brazil, China, India, and South Korea, as well as other regions of the world.

In addition, WiFi and Bluetooth both operate in the ISM (industrial, scientific, and medical) radio band that appears at or around 2400 MHz (more specifically, at 2450 MHz), and GPS operates at or around the 1575 MHz band.

Electronic device manufacturers are consistently looking for ways to lower the production and design costs of their electronic devices, and thereby increase profit margins, without losing the complexity and flexibility that users expect from today's devices. For example, given the broad range of frequency bands covered by each of the different RATs, as discussed above, it can be very challenging, and expensive, to design a single electronic device that includes sufficient antenna volume to support each of the various frequency bands and provides the demanding functionality that users have come to expect from, for example, wireless communications devices. However, it can also be very challenging, and expensive, to design individual variants of a given electronic device that specifically support a select combination of frequency bands, RATs, regions, and/or wireless carriers, especially if a layout of the electronic components (e.g., printed circuit board, battery, camera, speaker, etc.) within each variant differs in an attempt to achieve optimal antenna performance for the variants.

According to some aspects, one technique for improving the profitability of device manufacturing, as well as the antenna performance of multiple device variants, may include creating commonality in the layout and/or composition of internals components across all or most variants of a given electronic device. Such commonality in the shape and layout of internal components may translate to commonality in, for example, the antenna volume that is available across such variants and/or the possible arrangement or layout of antenna structures within these variants. For example, according to some embodiments, a geometry of a given antenna volume, and an antenna structure enclosed therein, can depend on or be determined by various factors, including a general shape of a housing of the electronic device (for example, a peripheral shape of the housing interior), a location and/or composition of a printed circuit board included within the housing (for example, locations and/or shapes of grounded portions (including conductive traces) and ungrounded portions of the printed circuit board), and/or a location, shape, and/or composition of other internal electronic components that are located at or near the antenna arrangement.

Accordingly, in one embodiment, a common antenna arrangement may be implemented in multiple variants of an electronic device by maintaining commonality in the configuration of the housing shape, printed circuit board (including the conductive traces included thereon), display area, and other conductive elements across each variant of the electronic device. Further, according to one embodiment, the shape of the housing and/or the placement of electronic components and other conductive elements within the electronic device may be configured to maximize the antenna volume of the common antenna arrangement, which can allow flexibility in the frequency banding of the antenna arrangement. Larger antenna volumes can also produce better antenna performance, at least because radiation efficiency and bandwidth can be a function of the volume occupied.

FIG. 1 depicts an example electronic device 100 consistent with some embodiments. It should be appreciated that the electronic device 100, as depicted, is merely an example and can include various combinations of hardware and/or software components. According to some embodiments, the electronic device 100 may be a mobile computing device, such as, for example, a smartphone or any other type of mobile communications device, a tablet, an e-reader, a portable gaming device, a portable media player, a personal digital assistant, a laptop computer, a desktop computer, or any other mobile or electronic device that includes one or more wireless communications devices. In FIG. 1, the electronic device 100 is depicted as a mobile device.

As shown in FIG. 1, the electronic device 100 may include a main body or housing 102 that houses a majority of the electronic components included in the mobile device. The housing 102 may be composed of plastic, metal, or any other suitable material. FIG. 1 illustrates a front face of the electronic device 100, as indicated by the positive orientation of the z-axis in axes 103. The electronic device 100 can include a display screen 104 and an antenna arrangement that is positioned within the housing 102 and includes antenna volumes 106, 108, and 110. Each of the antenna volumes 106, 108, and 110 can represent a three-dimensional space within the housing 102, as indicated by the dashed lines in FIG. 1, that can enclose one or more antenna structures (e.g., antenna structures 230, 232, and 234 shown in FIG. 2). As illustrated, the antenna volumes 106, 108, and 110 may be independent spaces that do not overlap with each other. This, at least in part, allows three distinct, or discontinuous, antenna structures to be placed individually within the three antenna volumes 106, 108, and 110, as will be discussed in more detail below.

FIG. 1 further illustrates that the housing 102 may include a bottom edge 112 and a top edge 114, and the top edge 114 may include a left corner 116 and a right corner 118. It should be noted that the terms "left," "right," "top," and "bottom" are used only for the purposes of providing reference to the relative positions of these edges/corners. According to one aspect, the antenna volume 106 may be positioned adjacent to an edge of the housing 102, such as the bottom edge 112, as shown in FIG. 1. Further, the antenna volumes 108 and 110 may be positioned adjacent to opposite corners of an opposing edge of the housing 102. For example, the antenna volume 108 may be disposed adjacent to the left corner 116 of the top edge 114 of the housing 102, and the antenna volume 110 may be disposed adjacent to the right corner 118 of the top edge 114 of the housing 102, as shown in FIG. 1.

Alternatively, or additionally, the antenna volumes 106, 108, and 110 may be disposed relative to the display screen 104 within the housing 102. The display screen 104 may include a bottom 120 and a top 122, and the top 122 may include two opposing corners, namely a first corner 124 and a second corner 126. According to one embodiment, the antenna volume 106 may be positioned adjacent to the bottom 120 of the display screen 104, the antenna volume 108 may be positioned adjacent to the first corner 124 of the top 122 of the display screen 104, and the antenna volume 110 may be positioned adjacent to the second corner 126 of the top 122 of the display screen 104.

According to some aspects, the positions of the antenna volumes 106, 108, and 110 relative to the display screen 104 may depend on performance and bandwidth requirements associated with the antenna structures enclosed in each antenna volume. For example, according to one aspect, one or more of the antenna volumes 106, 108, or 110 may be disposed, at least partially, within the spaces between the housing 102 and the display screen 104. As shown in FIG. 1, in one embodiment, the antenna volume 106 may be wholly positioned between the bottom edge 112 of the housing and the bottom 120 of the display screen 104. Such positioning may avoid overlap between the antenna volume 106 and the electronic components (not shown) of the display screen 104, which may increase the dimensions of the antenna volume 106.

According to one embodiment, the antenna volume 106 may be the largest antenna volume within the electronic device 100 and therefore, may enclose a "main" antenna (e.g., the Tx/Rx antenna) of the electronic device 100. The main antenna may require the largest antenna volume at least because of greater bandwidth requirements and higher performance expectations.

As another example, one or more of the antenna volumes 106, 108, or 110 may be positioned, at least partially, within the volumetric space located behind the display screen 104 within the housing 102. As shown in FIG. 1, according to one embodiment, the antenna volumes 108 and 110 may at least partially overlap with the display screen 104. Such positioning may cause the antenna volumes 108 and 110 to be smaller. As such, in one embodiment, the antenna volumes 108 and 110 may be configured to enclose antenna structures that have less stringent performance requirements.

Each of the antenna volumes 106, 108, and 110 can have a predetermined geometry or shape. According to one aspect, a predetermined geometry of the antenna volume 106 can be different from the predetermined geometry of the antenna volumes 108 and 110. For example, in FIG. 1, the antenna volume 106 is shown as having a rectangular shape, and each of the antenna volumes 108 and 110 are shown as having an "L-shaped" geometry. The actual geometry of each of the antenna volumes 106, 108, and 110 can vary depending on various factors related to the electronic device 100, as discussed in more detail below. The present disclosure is not limited to the exact geometry, shape, features, and/or dimensions depicted in FIG. 1 for the antenna volumes 106, 108, and 110. For example, according to some embodiments, the antenna volumes may have curved edges rather than the straight edges shown in FIG. 1 (see, e.g., FIG. 2). According to some aspects, the geometry of the antenna volume 108 can be mirrored relative to the geometry of the antenna volume 110 (or vice versa). In some cases, such mirrored geometries can allow for interchangeability between the antenna structures disposed within the antenna volumes 108 and 110.

According to some aspects, the electronic device 100 may be associated with a "family" of mobile devices, wherein each member of the family is a variant of the other mobile devices. This family of variants may have certain common features, such as, a common antenna arrangement, a common printed circuit board (including commonality in the layout of conductive traces), and/or a common layout of one or more other components within the electronic device 100. For example, according to one aspect, each of the antennas included in each variant may be tuned to operate within a specified range of frequencies across all variants, as described in more detail with respect to FIG. 2. Furthermore, each variant may have one or more differentiating features that set the variant apart from the rest of the family. For example, each variant may be configured to provide coverage for a specific combination of frequency bands, RATs, regions of the world, and/or wireless communications carriers. According to one aspect, each variant may also differ in terms of the RAT-specific electronic components that are mounted to a printed circuit board of the electronic device 100.

For example, in some embodiments, a first variant may be configured to operate within the UMTS and GSM systems (e.g., UMTS bands B1, B2, B5, and B8 and all four GSM bands or quad-band GSM), a second variant may be configured to operate within the GSM and CDMA systems (e.g., quad-band GSM and CDMA bands BC0, BC1, BC10, and BC15), a third variant may be configured to operate within the GSM system and the TD-SCDMA system in China (e.g., quad-band GSM and TD-SCDMA bands B34 and B39), a fourth variant may be configured to operate within the CDMA system (e.g., CDMA bands BC0, BC1, BC10, and BC15), and a fifth variant may be configured to operate within the CDMA and UMTS systems (e.g., UMTS bands B2, B4, and B5 and quad-band GSM). In addition to the RATs listed above, each of these five variants may also support other RATs, such as, e.g., GPS, WiFi, Bluetooth, NFC, etc. Other combinations of RATs, frequency bands, regions, and/or carriers may be provided in accordance with the principles disclosed herein. The present disclosure is not limited to these specific combinations.

Figure 2:
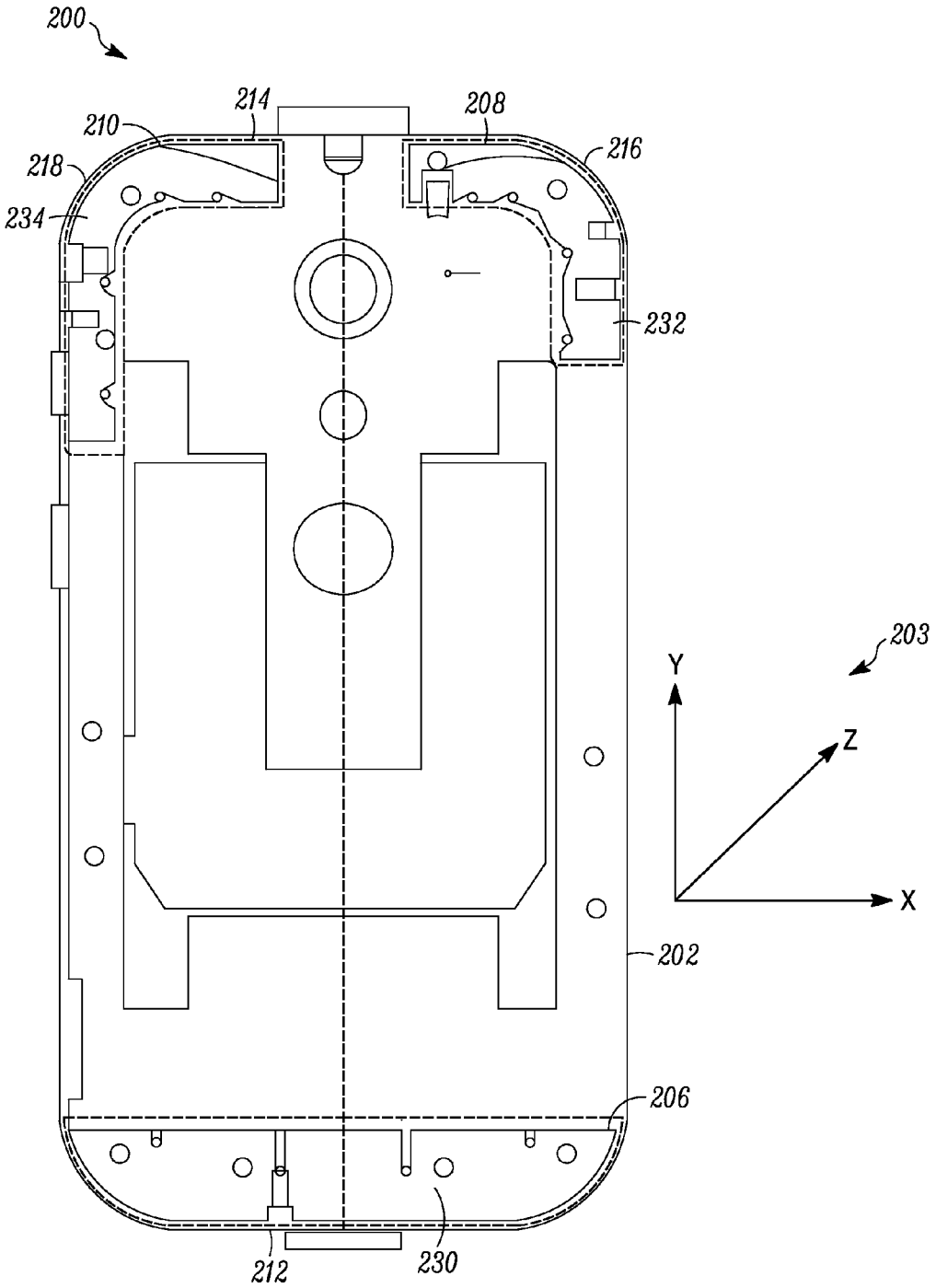
FIG. 2 illustrates an example back view of the interior of the electronic device of FIG. 1 and the example antenna structures included therein.

Referring additionally to FIG. 2, shown is an example electronic device 200 consistent with some embodiments. FIG. 2 illustrates an interior view of a back side of the electronic device 200 (e.g., with a back housing cover removed), as indicated by a negative orientation of the z-axis in axes 203. According to some aspects, the electronic device 200 may be substantially similar to the electronic device 100 shown in FIG. 1. For example, similar to the housing 102 of the electronic device 100, the electronic device 200 includes a housing 202 that includes a bottom edge 212 and a top edge 214 having a left corner 216 and a right corner 218. In some embodiments, the left corner 216 shown in FIG. 2 can correspond to the left corner 116 shown in FIG. 1, and the right corner 218 shown in FIG. 2 can correspond to the right corner 118 shown in FIG. 2.

Further, the electronic device 200 includes an antenna arrangement that has antenna volumes 206, 208, and 210 positioned in a layout that is substantially similar to the arrangement of antenna volumes 106, 108, and 110 depicted in FIG. 1. For example, the antenna volume 206 may be positioned adjacent to the bottom edge 212 of the housing 202, the antenna volume 208 may be positioned adjacent to the left corner 216 of the top edge 214 of the housing 202, and the antenna volume 210 may be positioned adjacent to the right corner 218 of the top edge 214 of the housing 202.

According to some aspects, the antenna arrangement of the electronic device 200 further includes antenna structures 230, 232, and 234. As illustrated, the antenna structure 230 may be enclosed within the antenna volume 206, the antenna structure 232 may be enclosed within the antenna volume 208, and the antenna structure 234 may be enclosed within the antenna volume 210. The antenna structures 230, 232, and 234 may incorporate any suitable type of antenna, such as, e.g., an inverted L-antenna, dual inverted L-antenna, inverted-F antenna, or hybrids of these antenna structures. For example, according to one embodiment, the antenna structure 230 can include a dual inverted L-antenna. Further, the antenna structures 232 and 234 can include inverted L-antennas. According to another embodiment, the antenna structure 230 can include an inverted-F antenna.

The antenna structures 230, 232, and 234 may be configured to support various types of wireless communications (or RATs), including non-cellular network communications (e.g., GPS, NFC, Bluetooth, WiFi, etc.) and voice and data cellular telephone communications (e.g., GSM, CDMA, UMTS, LTE, etc.). To this end, the antenna structures 230, 232, and 234 may be tuned to one or more of the frequency bands that are associated with the RATs supported by the electronic device 200. According to one aspect, the antenna structures 230, 232, and 234 need not be tuned to cover an RAT's entire banding, only the frequency bands that are specifically being utilized by the device 200.

Further, each of the antenna structures 230, 232, and 234 may serve different functions related to sending and receiving data. For example, the antennas may be a transmit (Tx) antenna that only sends voice and/or data communications, a receive (Rx) antenna that only receives voice and/or data communications, or a transmit/receive (Tx/Rx) antenna that both sends and receives voice and/or data communications. According to some aspects, the antenna arrangement may include two Rx antennas: a primary Rx antenna and a secondary or diversity Rx (DRx) antenna. The primary Rx antenna may be part of a main antenna (e.g., Tx/Rx antenna) of the device 200, and the DRx antenna may be configured to provide support to, or otherwise work in conjunction with, the primary Rx antenna to enhance the receive performance of the antenna arrangement. According to one aspect, the DRx antenna may be a separate antenna structure than the primary Rx antenna. In one example, to support CDMA band BC 15, the antenna arrangement may include a Tx antenna tuned to 1700 MHz, a primary Rx antenna tuned to 2100 MHz, and a DRx antenna tuned to 2100 MHz.

The specific function of an antenna included in the antenna arrangement of the electronic device 200 may depend at least partially on the particular communication needs of the electronic device 200, such as, for example, the different RATs, frequency bands, regions, and/or wireless carriers supported by the device 200 (e.g., as seen by the CDMA BC15 example above). Further, the function of the antenna placed within each of the antenna volumes 206, 208, and 210 may depend at least partially on a size, geometry, and/or layout of a given antenna volume. For example, Tx/Rx antennas generally require more antenna volume than, for example, Tx antennas or Rx antennas at least because Tx/Rx antennas need more bandwidth in order to cover both transmit and receive functions. As another example, Tx antennas generally require more antenna volume than, for example, Rx antennas at least because Tx antennas need higher antenna efficiency in order to satisfy performance requirements. Further, larger antenna volumes can allow for more flexibility in antenna banding (e.g., able to be tuned to more frequencies). Accordingly, in some embodiments, the main Tx/Rx antenna of an electronic device may be placed alone within the largest, discrete antenna volume of the antenna arrangement. For example, in the illustrated embodiment, the antenna volume 206 adjacent to the bottom edge 212 of the electronic device 200 may include the main Tx/Rx antenna.

The remaining antenna volumes (e.g., antenna volumes 208 and 210) may include one or more Tx, Rx, DRx, and/or Tx/Rx antennas. The function of the antenna included in these antenna volumes may depend on various factors, such as, e.g., the specific frequency banding desired for the associated antenna structures 232 and 234 and/or the types of RATs covered by the antenna arrangement. For example, antennas tuned to lower frequencies may be require more antenna volume than antennas tuned to higher frequencies. As another example, antennas covering similar frequency bands may be placed into one antenna volume.

According to some aspects, the electronic device 200 may be associated with a family of variants, as described above with respect to FIG. 1. According to one aspect, a common feature across the variants of this family may be the antenna banding (e.g., the frequencies to which individual antennas are tuned) in each variant. For example, in one embodiment, the bottom antenna structure 230 in each variant may be configured to transmit and receive signals over at least the 850 MHz and the 1900 MHz frequency bands (e.g., in accordance with CDMA, GSM, UMTS, and/or LTE systems). In another embodiment, the bottom antenna structure 230 in each variant may be configured to transmit and receive signals over the 850 MHz, 900 MHz, 1800 MHz, and 1900 MHz frequency bands (e.g., in accordance with GSM, UMTS, and/or LTE systems). In one embodiment, the antenna structure 234 in each variant may be configured to receive signals within frequency bands from 700 MHz to 2100 MHz (e.g., in accordance with CDMA and/or LTE systems). In one embodiment, the antenna structure 232 in each variant may be configured to receive signals over the 1575 MHz frequency band (e.g., in accordance with the GPS system). In another embodiment, the antenna structure 232 in each variant may be configured, additionally or alternatively, to transmit and/or receive signals within frequency bands of 2100 MHz or greater (e.g., in accordance with the Bluetooth, WiFi and/or LTE systems).

Referring back to FIG. 2, according to some aspects, a shape of each of the antenna structures 230, 232, and 234 can be determined, at least in part, by a shape of the antenna volumes 206, 208, and 210, respectively. The shape of the antenna volumes 206, 208, and 210 can be generally similar to the shape of the antenna volumes 106, 108, and 110, respectively. Also, like in FIG. 1, the antenna volume 206 can be shaped differently than the antenna volumes 208 and 210, and the general shape of the antenna volume 208 can be a mirror opposite of the general shape of the antenna volume 210. For example, as illustrated, the antenna volume 206 has an elongated shape that is substantially rectangular, like the antenna volume 106 shown in FIG. 1. And each of the antenna volumes 208 and 210 can have a substantially L-shaped geometry, like the antenna volumes 108 and 110 shown in FIG. 1.

As seen from FIGS. 1 and 2, the exact geometries of the antenna volumes 206, 208, and 210 may differ at least slightly from that of the antenna volumes 106, 108, and 110. According to one aspect, the geometries of the antenna volumes 206, 208, and 210 can be at least partially determined by the shape of an inner periphery of the housing 202. For example, a lower portion of the antenna volume 206 may be shaped substantially according to a geometry of the adjacent bottom edge 212 of the housing 202. As illustrated in FIG. 2, the lower portion of the antenna volume 206 can have a curved or rounded edge that follows, or is similar to, a curve of the adjoining bottom edge 212. Similarly, corner portions of the antenna volumes 208 and 210 that are adjacent to the left corner 216 and right corner 218, respectively, can have rounded edges that are shaped substantially according to the rounded geometries of the respective corners 216 and 218, as shown in FIG. 2.

According to some embodiments, the antenna structures 230, 232, and 234 may be shaped according to the corresponding antenna volumes 206, 208, and 210 and/or the geometries of the corresponding edges or corners of the housing 202. For example, like the antenna volume 206, the antenna structure 230 may be shaped substantially according to the geometry of the bottom edge 212. Like the antenna volume 208, the antenna structure 232 may be shaped substantially according to the geometry of the left corner 216. And like the antenna volume 210, the antenna structure 234 may be shaped substantially according to the geometry of the right corner 218 of the housing 202. The actual geometry of each of the antenna volumes 206, 208, and 210, and the antenna structures 230, 232, and 234 enclosed therein, can further depend on other factors related to the electronic device 200, as discussed in more detail below. The present disclosure is not limited to the exact geometry, shape, features, and/or dimensions depicted in FIG. 2 for the antenna volumes 206, 208, and 210 and the antenna structures 230, 232, and 234.

According to some embodiments, a shape and/or curvature of a rear housing portion of the housing 202 can also determine or impact aspects of the antenna arrangement. For example, in some embodiments, the edges of the antenna structures 230, 232, and 234 may correspond to the points of greatest curvature in the rear housing (e.g., the bottom edge 212, the top left corner 216, and/or the top right corner 218, respectively). At such points of greatest curvature, the width and/or height of the housing 202 may be more reduced than in other portions of the housing 202, thereby causing a reduction in available antenna volume at these points. This reduction in available antenna volume may cause the edges of the antenna structures 230, 232, and 234 to be correspondingly reduced. However, the edges of an antenna typically correspond to the points where electric current and radiation are the strongest for the antenna. Thus, greater rear housing curvature may result in an increased reduction in antenna power and radiation efficiency. According to some aspects, this may be especially problematic for antenna(s) adjacent to the top edge 214 of the electronic device 200, since due to various other factors discussed below, there may be less available antenna volume adjacent to the top edge 214 than to the bottom edge 212.

The antenna arrangement and/or volume of the electronic device 200 may further depend on a composition of the housing 202. For example, in some embodiments, the housing 202 may include a metal chassis or a grounded metal shield that can operate as a ground plane within the electronic device 200. The metal chassis may further operate as a shield between a user and the antenna structures 230, 232, and/or 234 to help reduce exposure to the radio frequency (RF) electromagnetic field emitted by the antennas of the device 200. The metal chassis may be configured to have a specific size or geometry to satisfy industry regulations related to at-head performance and Specific Absorption Rate (SAR), a measure of the rate at which energy is absorbed by a human body when exposed to a RF electromagnetic field. For example, there may be a request for more metal chassis at the top of the housing 202, where the antennas are closest to the user's head (e.g., when the user is holding a mobile phone to her ear), to keep the SAR measurements associated with the top region below regulatory thresholds. However, the metal chassis can also negatively affect the performance of the antenna arrangement given the close proximity between the metal chassis and the antennas.

For example, the addition of grounded metal to satisfy SAR shielding requirements may reduce antenna bandwidth and efficiency. To effectively mitigate these antenna issues, more antenna volume may be needed at the top of the electronic device 200. According to some aspects, selective cuts may be made to the metal chassis to increase antenna volume and thereby improve antenna radiation efficiency, particularly in locations where the metal chassis is near or adjacent the antenna arrangement. However, the ability to make chassis cutouts may be constrained in certain instances by SAR measurements close to regulatory limits. For example, antennas that are tuned to higher frequency bands tend to have high SAR measurements that may be at or close to the applicable SAR threshold (e.g., in the United States, the SAR limit is 1.6 Watts/kilogram (W/kg)).

Figure 3:
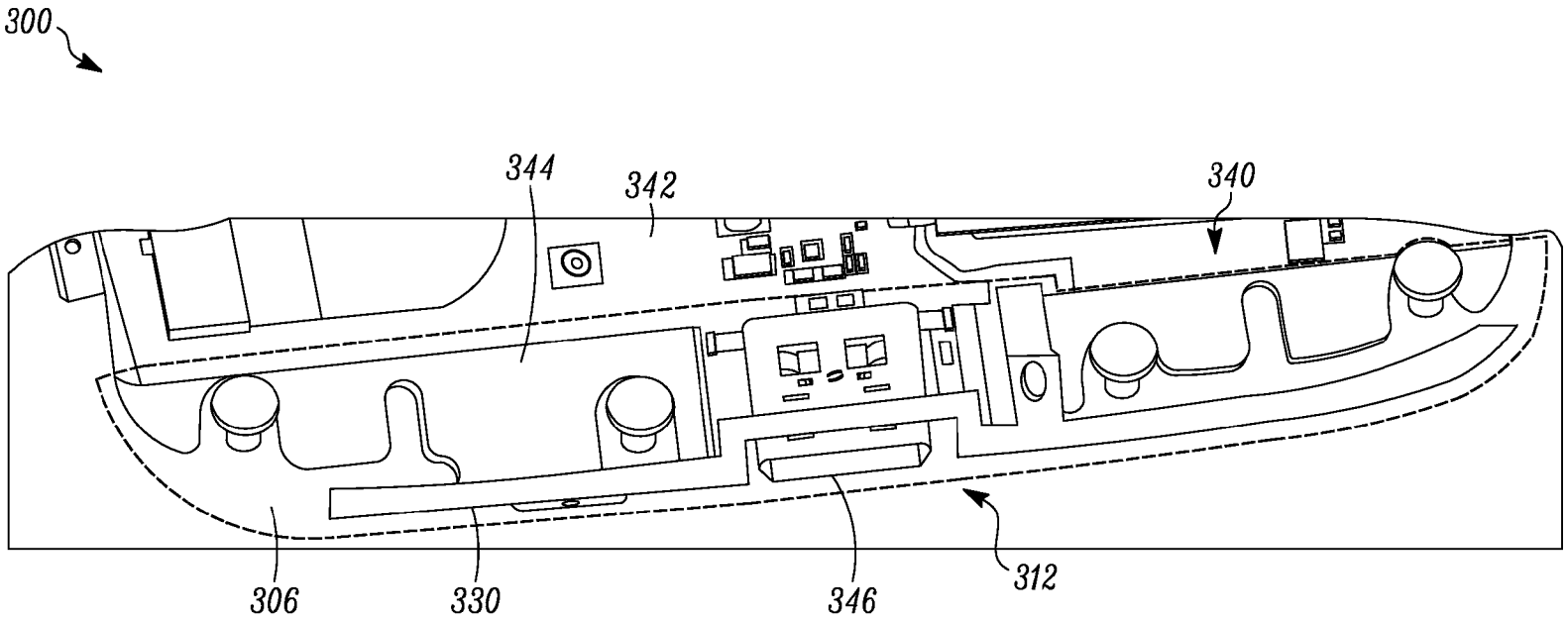
FIG. 3 illustrates an example expanded view of a portion of the electronic device of FIG. 2 and an example antenna structure included therein.

Referring additionally to FIG. 3, shown is an example electronic device 300 consistent with some embodiments. More specifically, FIG. 3 illustrates an internal, component level perspective view of a bottom portion of the electronic device 300. The electronic device 300 has an antenna arrangement that includes an antenna volume 306, which encloses an antenna structure 330, similar to the antenna volume 206 and antenna structure 230 of FIG. 2. As illustrated, the antenna structure 330 may be disposed adjacent to a bottom edge 312 of the electronic device 300.

The electronic device 300 may include one or more printed circuit boards, such as printed circuit board 340. The printed circuit board 340 may be formed from a rigid material (e.g., fiberglass-filled epoxy) or flexible sheets of material, such as polymers. Flexible printed circuit boards, or "flex circuits," may be formed from, for example, flexible sheets of polymide. The printed circuit board 340 can include a grounded portion 342 and an ungrounded portion 344. The grounded portion 342 of the printed circuit board 340 may incorporate conductive or metal elements that can interfere with performance of the antenna structure 330 if placed adjacent to, or in close proximity to, the antenna structure 330. For example, the printed circuit board 340 may include interconnects, formed from conductive traces (e.g., traces of gold, copper, or other metals), and connectors that connect to the interconnects using, for example, solder or conductive adhesive. In addition, a plurality of electronic components (e.g., integrated circuits, discrete components such as resistors, capacitors, and inductors, etc.) may be mounted to (e.g., soldered onto) the printed circuit board 340 via, for example, the connectors. Furthermore, the printed circuit board 340 may be coupled to other electronic components, such as, one or more display components (such as, e.g., the display screen 104 in FIG. 1), battery components (such as, e.g., power module 850 in FIG. 8), audio components (such as, e.g, speaker 862 in FIG. 8), image capturing components (such as, e.g., camera 856 in FIG. 8), and external connectors (such as, e.g., USB connector 346 in FIG. 3).

According to an aspect, the printed circuit board 340 of each variant of the electronic device 300 may include a substantially similar layout of conductive traces, but may differ in terms of the electronic components that are coupled thereto. For example, the printed circuit board 340 for each variant may include one or more electronic components that are specific or unique to the RAT supported by that variant, and in each variant, the corresponding RAT-specific component(s) may be connected to corresponding locations and/or conductive traces of the printed circuit board 340. In one embodiment, a variant that supports the GSM system may include a GSM-specific integrated circuit, and a variant that supports the CDMA system may include a CDMA-specific integrated circuit. Since the conductive traces of the printed circuit board 340 may be the same across variants, the GSM-specific integrated chip may be mounted to the printed circuit board 340 of the GSM variant in substantially the same position (e.g., connected to substantially the same conductive traces at substantially the same locations), as the CDMA-specific integrated chip in the printed circuit board 340 of the CDMA variant.

The ungrounded portion 344 of the printed circuit board 340 may be considered a "safe zone" for placement of the antenna structure 330, at least partially due to the lack of conductive elements within this region of the printed circuit board 340. According to some aspects, the ungrounded portion 344 may provide the antennas with a volume in which to radiate. As a result, according to some embodiments, the antenna volume 306 includes the ungrounded portion 344 of the printed circuit board 340. Likewise, though not shown in FIG. 3, any ungrounded portions located at a top of the printed circuit board 340 may be included in any antenna volumes located in a top portion of the electronic device 300 (similar to, for example, antennas volumes 208 and 210 in FIG. 2).

Further, the antenna volume 306, and any other antenna volumes included within the antenna arrangement of the electronic device 300, may include a "keepout clearance," or a three-dimensional spatial barrier between antenna structures and nearby conductive elements (e.g., including the grounded portion 342 (including the conductive traces) of the printed circuit board 340 and the electronic components mounted thereto). The keepout clearance may help achieve optimal antenna performance by minimizing interference between the antennas and nearby metal and preventing power from shorting out the antennas. In this respect, according to some aspects, the antenna volume 306 may represent the entire three-dimensional space required by, or occupied in association, with the antenna structure 330 within the electronic device 300.

Given the above, the geometry, size, location and/or layout of the antenna arrangement of the electronic device 300 (including the antenna volume 306, the antenna structure 330 enclosed therein, and any other antenna volumes and structures) can depend on or be determined by a geometry, size, location and/or layout of the electronic components within the electronic device 300 that are positioned close enough to the antennas to create the need for keepout clearances. Such components may include, for example, the printed circuit board 340, including the ungrounded portion 344 and/or the grounded portion 342 (e.g., including the conductive traces), other electronic components of the electronic device 300, and any other conductive elements within the electronic device 300. In some embodiments, the composition and/or layout of components at or near a top edge (not shown) of the electronic device 300 may result in smaller antenna volume availability, and the composition and/or layout of components at or near the bottom edge 312 may result in larger antenna volume availability. For example, the top of the electronic device 300 may include a greater concentration of electronic components (such as, e.g., the camera 856, the speaker 862, and the external port 854 of FIG. 8) than the bottom of the electronic device 300. According to some aspects, the components within the electronic device 300 may be configured to help maximize available antenna volume by, for example, reducing a size or footprint of the components, reducing the number of components, for example, with the help of multipurpose components, and/or arranging placement of the components to be as far away as possible from the edges of the electronic device 300 (e.g., where the antennas are located).

Figure 4:
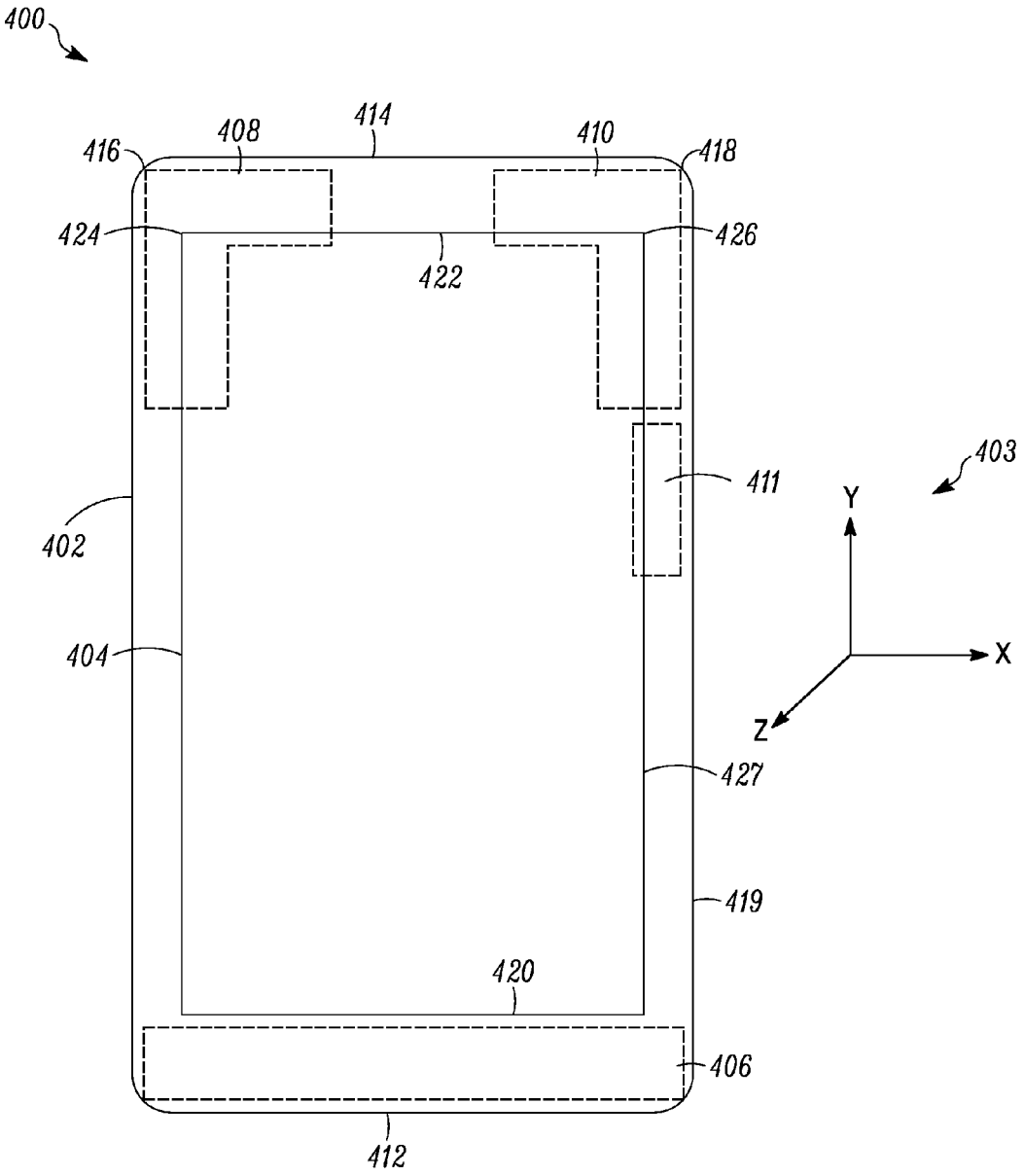
FIG. 4 illustrates an example front view of an electronic device including an antenna arrangement in accordance with some embodiments.

Referring now to FIG. 4, shown is an example electronic device 400 consistent with some embodiments. The electronic device 400 may be a mobile computing device or other wireless communications device. According to some aspects, the electronic device 400 may be associated with the family of mobile devices discussed above with respect to FIG. 1. For example, according to one aspect, the electronic device 400 may be an additional variant of the above-described family (e.g., a sixth variant) configured to operate within the LTE systems (e.g., three or more of LTE bands 1, 2, 3, 4, 5, 7, 8, 12, 13, 17, 20, 25, 38, or 41).

As shown in FIG. 4, the electronic device 400 may include a housing 402 that houses a majority of the electronic components included in the electronic device 400. FIG. 4 illustrates a front face of the electronic device 400, as indicated by the positive orientation of the z-axis in axes 403. The electronic device 400 can include a display screen 404 and an antenna arrangement that is positioned within the housing 402. The antenna arrangement may include antenna volumes 406, 408, 410, and 411, each of which represents a three-dimensional space within the housing 402, as indicated by the dashed lines in FIG. 4, that can enclose one or more antenna structures (e.g., antenna structures 530, 532, 534, and 535 shown in FIG. 5). As illustrated, the antenna volumes 406, 408, 410, and 411 may be independent spaces that do not overlap with each other. This, at least in part, allows four distinct, or discontinuous, antenna structures to be placed individually within the four antenna volumes 406, 408, 410, and 411, as will be discussed in more detail below.

FIG. 4 further illustrates that the housing 402 may include a bottom edge 412 and a top edge 414, and the top edge 414 may include a left corner 416 and a right corner 418. The housing 402 may further include a lateral edge 419 that includes a first end adjacent to the right corner 418 and a second end adjacent to the bottom edge 412. It should be noted that the terms "left," "right," "top," and "bottom" are used only for the purposes of providing reference to the relative positions of these edges/corners.

According to one aspect, the antenna volume 406 may be positioned adjacent to an edge of the housing 402, such as the bottom edge 412, as shown in FIG. 4. Further, the antenna volumes 408 and 410 may be positioned adjacent to opposite corners of an opposing edge of the housing 402. For example, the antenna volume 408 may be disposed adjacent to the left corner 416 of the top edge 414 of the housing 402, and the antenna volume 410 may be disposed adjacent to the right corner 418 of the top edge 414 of the housing 402, as shown in FIG. 4. In addition, according to one embodiment, the antenna volume 411 may be positioned adjacent to the lateral edge 419 and/or the antenna volume 410, as can be seen in FIG. 4.

Alternatively, or additionally, the antenna volumes 406, 408, 410, and 411 may be disposed relative to the display screen 404 within the housing 402. The display screen 404 may include a bottom 420 and a top 422, the top 422 including two opposing corners, namely a first corner 424 and a second corner 426. The display screen 404 may further include a side 427. According to one embodiment, the antenna volume 406 may be positioned adjacent to the bottom 420 of the display screen 404, the antenna volume 408 may be positioned adjacent to the first corner 424 of the top 422 of the display screen 404, the antenna volume 410 may be positioned adjacent to the second corner 426 of the top 422 of the display screen 404, and the antenna volume 411 may be positioned adjacent to the side 427 of the display screen 404.

As discussed above with respect to FIG. 2, in some embodiments, one or more of the antenna volumes 406, 408, 410, or 411 may be disposed, at least partially, in the spaces between the housing 402 and the display screen 404. For example, in FIG. 4, the antenna volume 406 is shown as being positioned wholly between the bottom edge 412 of the housing and the bottom 420 of the display screen 404. In other embodiments, one or more of the antenna volumes 406, 408, 410, or 411 may be positioned, at least partially, within the volumetric space located behind the display screen 404 within the housing 402. For example, as shown in FIG. 4, the antenna volumes 408 and 410 may at least partially overlap with the displayed screen 404.

Each of the antenna volumes 406, 408, 410, and 411 can have a predetermined geometry or shape. According to one aspect, a predetermined geometry of the antenna volume 406 can be different from the predetermined geometry of the antenna volumes 408, 410, and 411. For example, in FIG. 4, the antenna volume 406 is shown as having a long rectangular shape, each of the antenna volumes 408 and 410 are shown as having an "L-shaped" geometry, and the antenna volume 411 is shown as having a short rectangular shape. The actual geometry of each of the antenna volumes 406, 408, 410, and 411 can vary depending on various factors related to the electronic device 400, as discussed in more detail above. The present disclosure is not limited to the exact geometry, shape, features, and/or dimensions depicted in FIG. 4 for the antenna volumes 406, 408, 410, and 411. For example, according to some embodiments, the antenna volumes may have curved edges rather than the straight edges shown in FIG. 4 (see, e.g., FIG. 5). According to some aspects, the geometry of the antenna volume 408 can be mirrored relative to the geometry of the antenna volume 410 (or vice versa).

Figure 5:
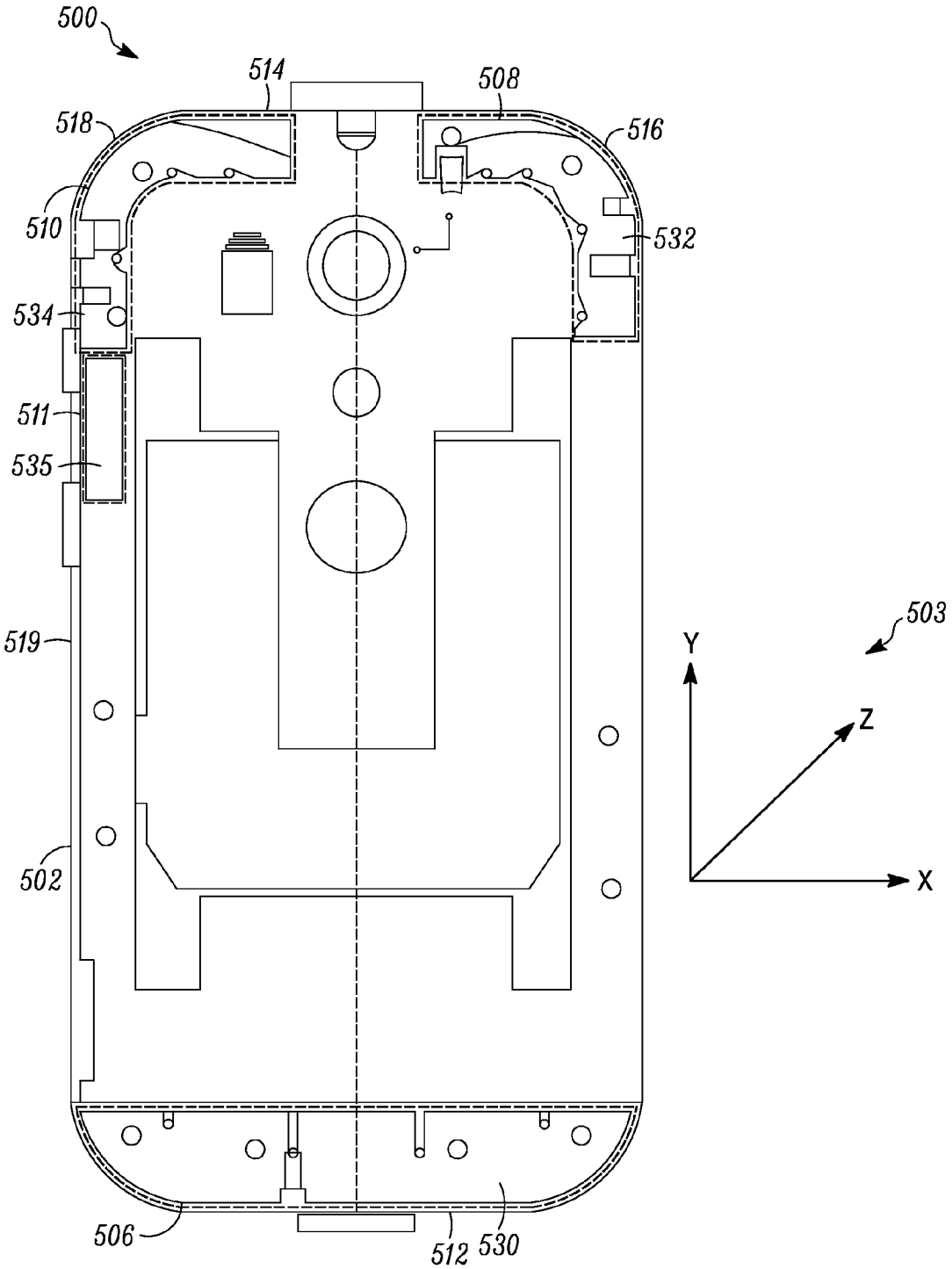
FIG. 5 illustrates an example back view of the interior of the electronic device of FIG. 4 and the example antenna structures included therein.

Referring additionally to FIG. 5, shown is an example electronic device 500 consistent with some embodiments. FIG. 5 illustrates an interior view of a back side of the electronic device 500 (e.g., with a back housing cover removed), as indicated by a negative orientation of the z-axis in axes 503. According to some aspects, the electronic device 200 may be substantially similar to the electronic device 400 shown in FIG. 4. For example, similar to the housing 402 of the electronic device 400, the electronic device 500 includes a housing 502 that includes a bottom edge 512, a top edge 514 having a left corner 516 and a right corner 518, and a lateral edge 519. In some embodiments, the left corner 516 shown in FIG. 5 can correspond to the left corner 416 shown in FIG. 4, and the right corner 518 shown in FIG. 5 can correspond to the right corner 418 shown in FIG. 4.

Further, the electronic device 500 includes an antenna arrangement that has antenna volumes 506, 508, 510, and 511 positioned in a layout that is substantially similar to the arrangement of antenna volumes 406, 408, 410, and 411 depicted in FIG. 4. For example, the antenna volume 506 may be positioned adjacent to the bottom edge 512 of the housing 502, the antenna volume 508 may be positioned adjacent to the left corner 516 of the top edge 514 of the housing 502, the antenna volume 510 may be positioned adjacent to the right corner 518 of the top edge 514 of the housing 502, and the antenna volume 511 may be positioned adjacent to the lateral edge 519 of the housing 502.

According to some aspects, the antenna arrangement of the electronic device 500 further includes antenna structures 530, 532, 534, and 535. As illustrated, the antenna structure 530 may be enclosed within the antenna volume 506, the antenna structure 532 may be enclosed within the antenna volume 508, the antenna structure 534 may be enclosed within the antenna volume 510, and the antenna structure 535 may be enclosed within the antenna volume 511. The antenna structures 530, 532, 534, and 535 may incorporate any suitable type of antenna, such as, e.g., an inverted L-antenna, dual inverted L-antenna, inverted-F antenna, or hybrids of these antenna structures. For example, according to one embodiment, the antenna structure 530 can include a dual inverted L-antenna. Further, the antenna structures 532, 534, and/or 535 can include inverted L-antennas. According to another embodiment, the antenna structure 530 can include an inverted-F antenna.

According to some embodiments, the antenna structures 530, 532, 534, and 535 may be configured to support voice and data cellular telephone communications over the LTE network, as well as various types of non-cellular network communications (e.g., GPS, NFC, Bluetooth, WiFi, etc.). For example, according to one embodiment, the bottom antenna structure 530 may be configured to be a main Tx/Rx antenna tuned to a plurality of frequency bands (e.g., at least three of the following Americas LTE frequency bands: 2, 3, 4, 5, 12, 13, 17, or 2), the antenna structure 534 may be configured to be a Tx/Rx antenna tuned to at least the LTE band B17 (e.g., 700 MHz), the antenna structure 532 may be configured to be a Tx/Rx antenna tuned to at least the LTE band B7 (e.g., 2600 MHz) and the GPS band (e.g., 1575 MHz), and the antenna structure 535 may be configured to be a DRx antenna tuned to at least the LTE band B7 and the WiFi band and/or the Bluetooth band (e.g., 2400 MHz).

As will be appreciated, FIGS. 2 and 5 may be substantially similar except for the addition of antenna volume 511 and antenna structure 535 in FIG. 5. One reason for this addition may have been the need to accommodate the large range of LTE frequency bands (e.g., between 700 MHz and 2600 MHz) supported by the variant depicted in FIG. 5. More specifically, according to one aspect, constraints on the antenna volume 506 within the housing 502 may not allow the main Tx/Rx antenna 530 to accommodate all LTE frequency bands at once. Moreover, to meet antenna design and performance requirements, each frequency band is typically associated with one Tx antenna and two Rx antennas, or one Tx/Rx antenna and one Rx antenna. In order to cover all of the LTE frequency bands supported by the variant of FIG. 5, the antenna arrangement of FIG. 5 moves select frequency bands to the top antenna structures 532, 534, and 535. The decision regarding which frequency bands to move to the antenna structures 532, 534, and 535 may depend on various factors, including the antenna volume available in the top region of the electronic device 500 and the antenna volume demands of certain frequency bands.

For example, as discussed above, Tx/Rx antennas usually require more antenna volume than Tx only or Rx only antennas. Further, lower frequency bands may require more antenna volume to meet antenna performance requirements. For at least these reasons, the antenna structure 534 in the antenna volume 510 may be configured to be a Tx/Rx antenna tuned only to the low frequency band 700 MHz in support of LTE band B17, and the antenna structure 532 in the antenna volume 508 may be configured to be a Tx/Rx antenna that is configured to transmit and receive at the high frequency band 2600 MHz in support of LTE band B7 and to receive at the 1575 MHz frequency band in support of GPS. Further, to provide the additional receive antennas for bands B7 and B17, the main Tx/Rx antenna 530 may be tuned to receive signals at the 700 MHz frequencies of band B17, and the antenna structure 535 may be tuned to receive signals at the 2600 MHz frequencies of band B7. Given the heavy banding of antenna structure 532 (e.g., little to no remaining antenna volume for additional banding) and the closeness in frequency of the Bluetooth band (2400 MHz), the WiFi band (2400 MHz), and the B7 band (2600 MHz), the antenna structure 535 may be further configured to transmit and receive Bluetooth and WiFi signals.

Figure 6:
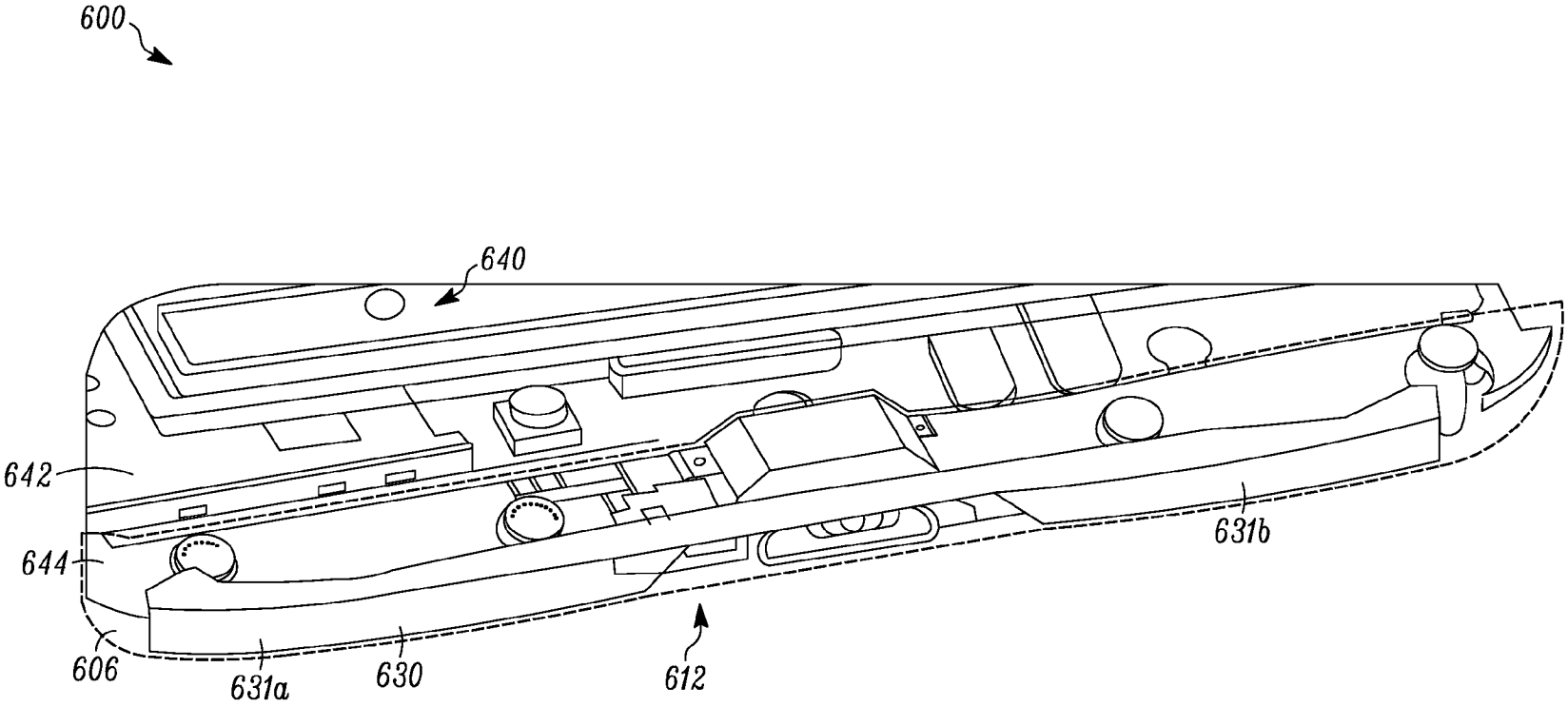
FIG. 6 illustrates an example expanded view of a portion of the electronic device of FIG. 5 and an example antenna structure included therein.

Referring now to FIG. 6, shown is an example electronic device 600 consistent with some embodiments. More specifically, FIG. 6 illustrates an internal, component level perspective view of a bottom portion of the electronic device 600. The electronic device 600 has an antenna arrangement that includes an antenna volume 606, which encloses an antenna structure 630, similar to the antenna volume 506 and antenna structure 530 of FIG. 5. As illustrated, the antenna structure 630 may be disposed adjacent to a bottom edge 612 of the electronic device 600.

As further shown in FIG. 6, the electronic device 600 includes a printed circuit board 640. The printed circuit board 640 includes a grounded portion 642 and an ungrounded portion 644. The grounded portion 642 of the printed circuit board 640 may incorporate conductive or metal elements that can interfere with performance of the antenna structure 630 if placed adjacent to, or in close proximity to, the antenna structure 630, as discussed above with respect to FIG. 3. The ungrounded portion 644 of the printed circuit board 640 may be considered a "safe zone" for placement of the antenna structure 630, at least partially due to the lack of conductive elements within this region of the printed circuit board 640. According to some embodiments, the antenna volume 606 includes the ungrounded portion 644 of the printed circuit board 640. Likewise, though not shown in FIG. 6, any ungrounded portions located at a top of the printed circuit board 640 may be included in any antenna volumes located in a top portion of the electronic device 600 (similar to, for example, antennas volumes 508, 510, and 511 in FIG. 5).

Further, the antenna volume 606, and any other antenna volumes included within the antenna arrangement of the electronic device 600, may include a "keepout clearance," as discussed above with respect to FIG. 3. According to some aspects, the antenna volume 606 may represent the entire three-dimensional space required by, or occupied in association, with the antenna structure 630 within the electronic device 600. According to one aspect, the antenna structure 630 includes antenna arms 631*a* and 631*b* that have been extended close to the bottom edge 612 of the housing 602 in order to maximize the keepout clearance of the antenna volume 606, and thereby increase radiation bandwidth.

Figure 7:
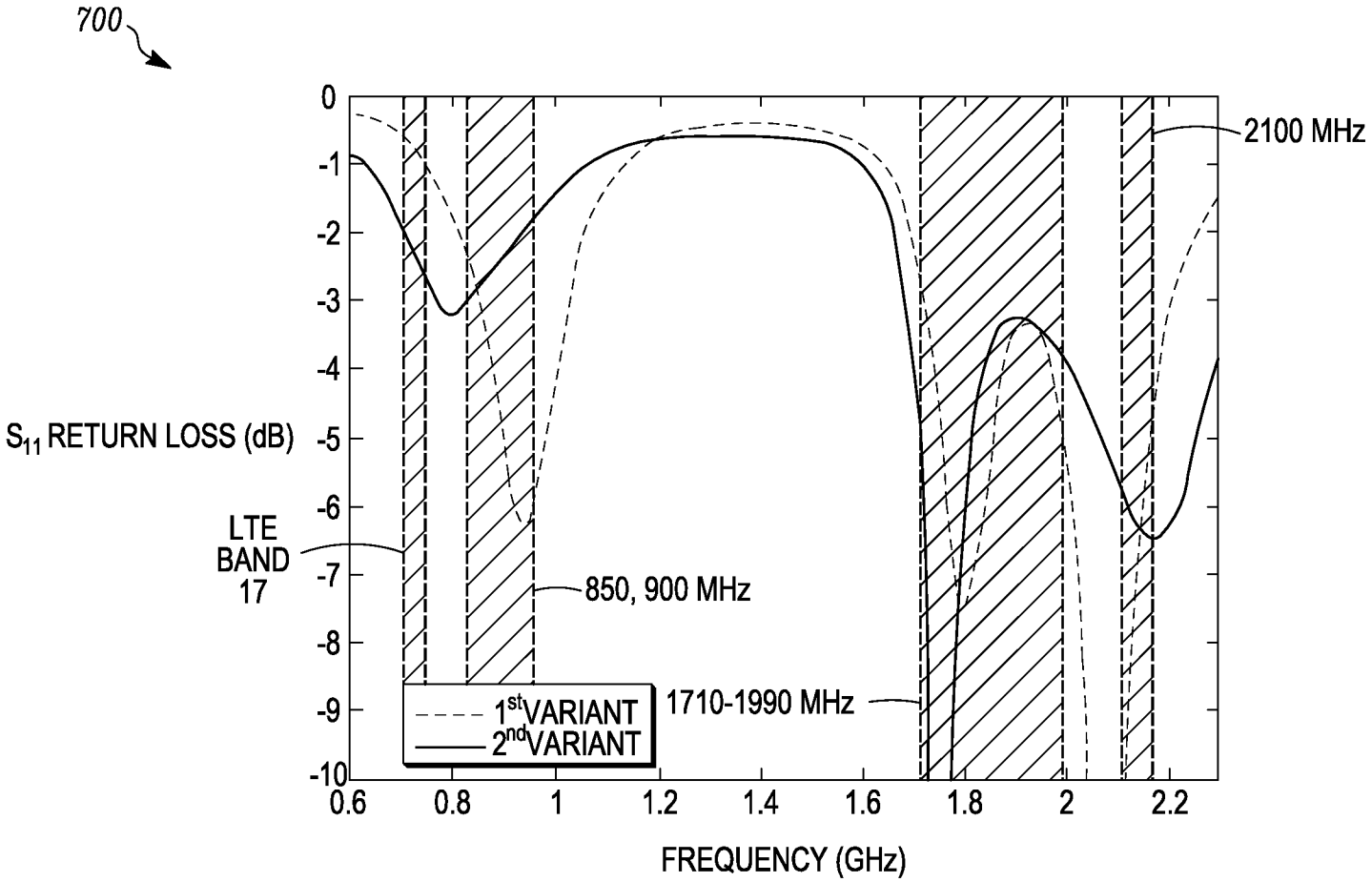
FIG. 7 is a graph comparing the performance of two embodiments.

Referring now to FIG. 7, shown is a chart 700 comparing simulated free space return loss measurements related to the variants depicted in, for example, FIGS. 3 and 6. More specifically, according to one aspect, the dashed line in chart 700 may represent any of variants 1 through 5 (e.g., first variant) from FIG. 3, and the solid line may represent the variant 6 (e.g., second variant) from FIG. 6. The chart 700 shows that attempts to tune the bottom antennas 334, 634 to lower frequency bands and provide sufficient bandwidth to cover LTE band 17 sacrifices at least some low band performance in the second variant as compared to the first variant. This may be especially apparent in the 900 MHz band, where the return loss for the second variant at the edge of the 900 MHz band is approximately 3 dB, while the return loss of the first variant at the same edge is approximately 2 dB.

Figure 8:
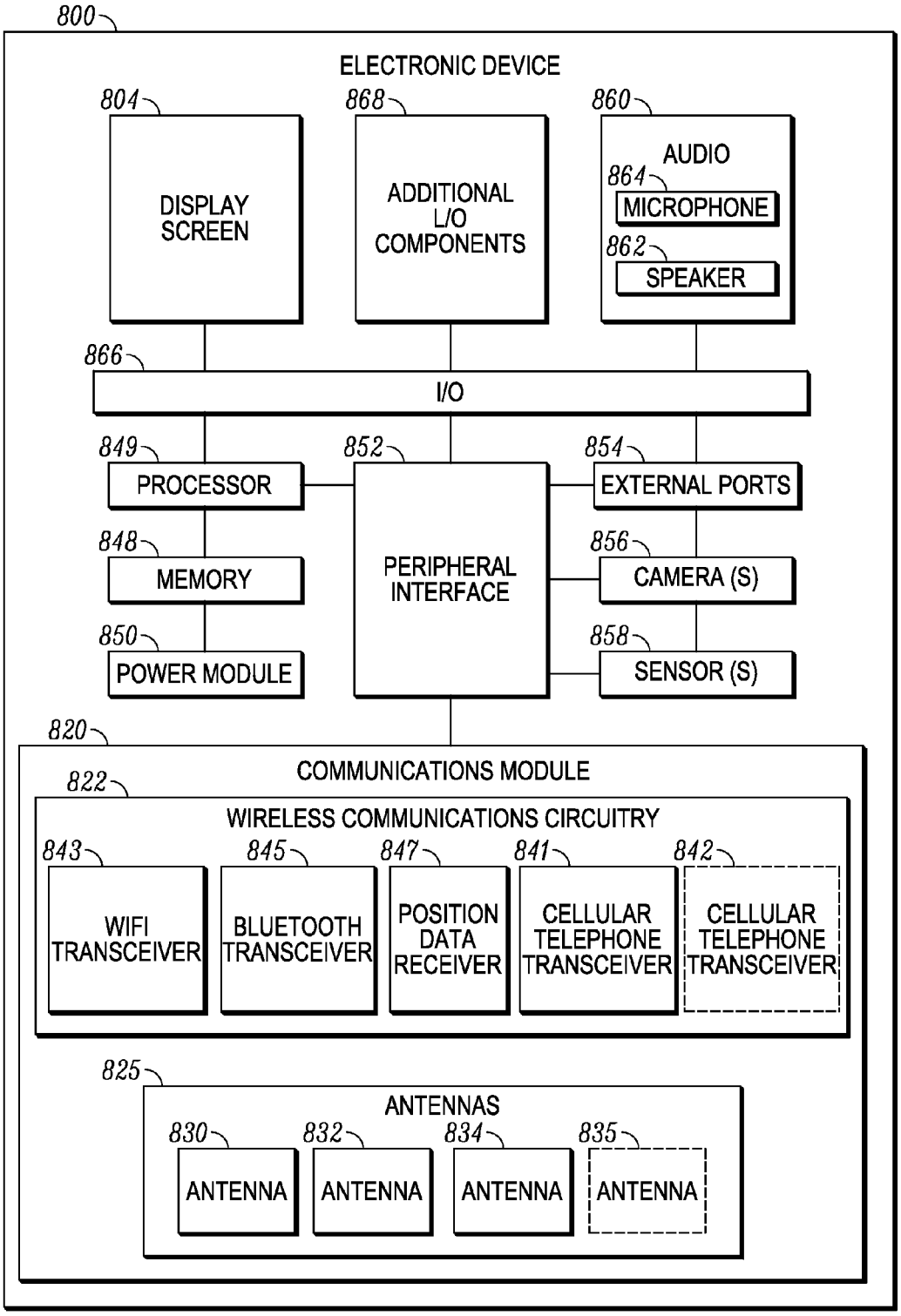
FIG. 8 is a block diagram of an example electronic device including an antenna arrangement in accordance with some embodiments.

Referring now to FIG. 8, shown is an example electronic device 800 in which some embodiments may be implemented. As described above, the electronic device 800 can include a display screen 804. The communication module 820 may include wireless communications circuitry 822 and a plurality of antennas 825. According to one embodiment, the plurality of antennas can include antennas 830, 832, and 834 (e.g., like antennas 230, 232, and 234 in FIG. 2). According to another embodiment, the plurality of antennas can further include antenna 835 (e.g., like antenna 535 in FIG. 5). The wireless communications circuitry may include one or more WWAN transceivers (such as, e.g., cellular telephone transceivers 841, 842) configured to communicate with a wide area network, including one or more cell sites or base stations to communicatively connect the electronic device 800 to additional devices or components. Further, the communication module 820 can include one or more WLAN and/or WPAN transceivers, such as WiFi transceiver 843 and Bluetooth transceiver 845, that are configured to connect the electronic device 800 to local area networks and/or personal area networks, such as a WiFi network and/or a Bluetooth network. In addition, the communications module 820 can include one or more position data receiver 847 that are configured to obtain position-related data, or GPS coordinates, from a position data network, such the GPS system. Still further, the communication module 820 can include one or more point-to-point transceivers (not shown) configured to connect the electronic device 800 short-range communication networks, such as, e.g., near-field-communication (NFC) and/or radio frequency identification (RFID).

The electronic device 800 may further include other components, such as, a memory 848 (e.g., hard drives, flash memory, MicroSD cards, and others) and a processor 849. Memory 848 can have a distributed architecture where various components are situated remote from one another, but are still accessed by the processor 849. These other components may reside on devices located elsewhere on a network or in a cloud arrangement.

Further, the electronic device 800 can include a power module 850 (e.g., flexible batteries, wired or wireless charging circuits, etc.), a peripheral interface 852, and one or more external ports 854 (e.g., Universal Serial Bus (USB), HDMI, Firewire, and/or others). The communication module 820 can be configured to interface with the one or more external ports 854. For example, the communication module 820 can include one or more additional transceivers functioning in accordance with IEEE standards, 3GPP standards, or other standards, and configured to receive and transmit data via the one or more external ports 854.

The electronic device 800 can further include a camera 856 for capturing images and/or video; one or more sensors 858, such as, for example, accelerometers, gyroscopic sensors (e.g., three angular-axis sensors), additional proximity sensors, tilt sensors, and/or other sensors; and an audio module 860 including hardware components such as a speaker 862 for outputting audio and a microphone 864 for receiving audio. In some embodiments, the speaker 862 and the microphone 864 can be piezoelectric components. The electronic device 800 further includes an input/output (I/O) controller 866.

The electronic device 800 can further include additional I/O components 868 (e.g., capacitors, keys, buttons, lights, LEDs, cursor control components, haptic components, touch-sensitive components, and others). The display screen 804 and the additional I/O components 868 may be considered to form portions of a user interface (e.g., portions of the electronic device 800 associated with presenting information to the user and/or receiving inputs from the user). In some embodiments, the display screen 804 is a touchscreen display using singular or combinations of display technologies such as electrophoretic displays, electronic paper, polyLED displays, OLED displays, AMOLED displays, liquid crystal displays, electrowetting displays, rotating ball displays, segmented displays, direct drive displays, passive-matrix displays, active-matrix displays, and/or others.

In general, a computer program product in accordance with an embodiment includes a computer usable storage medium (e.g., standard random access memory (RAM), an optical disc, a universal serial bus (USB) drive, or the like) having computer-readable program code embodied therein, wherein the computer-readable program code is adapted to be executed by the processor 849 (e.g., working in connection with an operating system) to implement a method for arranging antennas as described below. In this regard, the program code may be implemented in any desired language, and may be implemented as machine code, assembly code, byte code, interpretable source code or the like (e.g., via C, C++, Java, Actionscript, Objective-C, Javascript, CSS, XML, and/or others).

Figure 9:
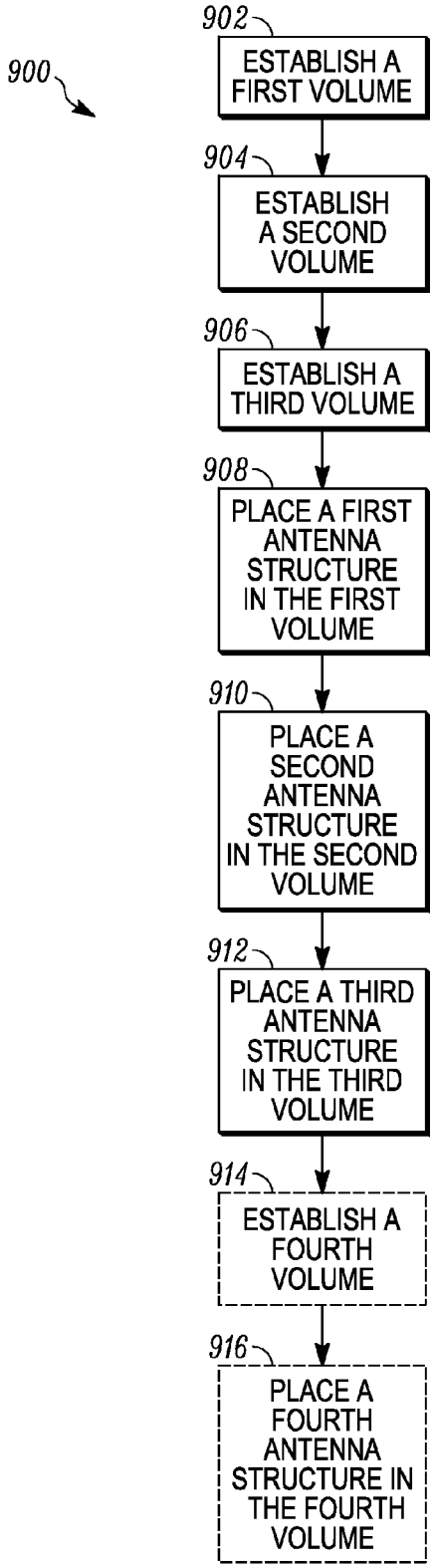
FIG. 9 is a flow diagram depicting control of arranging antenna structures in an electronic device in accordance with some embodiments.

FIG. 9 is a flowchart of a method 900 for controlling functions associated with arranging antennas within an electronic device having a housing. The method 900 may begin at step 902, which includes establishing a first volume without conductive elements adjacent to an edge of the housing. The method 900 may continue to step 904, which includes establishing a second volume without conductive elements adjacent to a first corner of an opposing edge of the housing. At step 906, the method 900 includes establishing a third volume without conductive elements adjacent to a second corner of the opposing edge of the housing.

The method 900 may continue to step 908, which includes placing a first antenna structure in the first volume, wherein the first antenna structure may be configured to transmit and/or receive signals within frequency bands from 800 MHz to 1900 MHz. For example, the first antenna structure may be configured to transmit and/or receive over all four GSM bands, UMTS bands B1, B2, B5 and B8, and/or CDMA bands BC0, BC1, BC10, and BC15 (transmit only). The method 900 may further include step 910, which involves placing a second antenna structure in the second volume, wherein the second antenna structure may be configured to receive signals within frequency bands from 700 MHz to 2100 MHz. For example, the second antenna structure may be configured to transmit and/or receive over CDMA band BC 15 (receive only) and/or UMTS band B1. Step 912 includes placing a third antenna structure in the third volume, wherein the third antenna structure is configured to receive signals within the frequency bands of 2100 MHz and greater. For example, the third antenna structure may be configured to transmit and/or receive over CDMA band BC15 (receive only), the Wifi band, and/or the Bluetooth band. In another embodiment, the third antenna structure may be further configured to receive signals within the 1575 MHz band (e.g., for GPS systems).

According to some embodiments, the third antenna structure is also configured to transmit signals within frequency bands over 2100 MHz. Further, in one embodiment, the method 900 may also include step 914, which includes establishing a fourth volume without conductive elements adjacent to a lateral edge of the housing, and step 916, which includes placing a fourth antenna structure in the fourth volume, wherein the fourth antenna structure is configured to transmit and receive signals with frequencies over 2000 MHz.

According to some aspects, the method 900, including steps 914 and 916, may be carried out in order to provide an antenna arrangement that is capable of operating within LTE frequency bands. For example, the first antenna structure may be configured for receiving and/or transmitting three or more of the following Americas LTE bands: 2, 3, 4, 5, 12, 13, 17, or 25; the second antenna structure may be configured for receiving and transmitting over LTE band B17; the third antenna structure may be configured for receiving and transmitting over LTE band B7 and the GPS band; and the fourth antenna structure may be configured for receiving over LTE band B7, the Bluetooth band, and the WiFi band.

This disclosure is intended to explain how to fashion and use various embodiments in accordance with the technology rather than to limit the true, intended, and fair scope and spirit thereof. The foregoing description is not intended to be exhaustive or to be limited to the precise forms disclosed. Modifications or variations are possible in light of the above teachings. The embodiment(s) were chosen and described to provide the best illustration of the principle of the described technology and its practical application, and to enable one of ordinary skill in the art to utilize the technology in various embodiments and with various modifications as are suited to the particular use contemplated. All such modifications and variations are within the scope of the embodiments as determined by the appended claims, as may be amended during the pendency of this application for patent, and all equivalents thereof, when interpreted in accordance with the breadth to which they are fairly, legally and equitably entitled.

What is claimed is:

1. An electronic device, comprising:

a housing having an edge, a first corner of an opposing edge, and a second corner of the opposing edge, the edge including a third corner and a fourth corner opposite the third corner;

a printed circuit board having a grounded portion and an ungrounded portion; and an antenna arrangement positioned within the housing, the antenna arrangement including:

a first volume positioned adjacent to the edge and extending from the third corner to the fourth corner, the first volume enclosing a first antenna structure that is shaped substantially according to a geometry of the edge, a second volume positioned adjacent to the first corner, the second volume enclosing a second antenna structure that is shaped substantially according to a geometry of the first corner, and a third volume positioned adjacent to the second corner, the third volume enclosing a third antenna structure that is shaped substantially according to a geometry of the second corner, wherein the first, second, and third volumes of the antenna arrangement do not overlap, and the first, second, and third antenna structures are discontinuous, wherein at least one of the first volume, the second volume, and the third volume includes the ungrounded portion.

2. The electronic device of claim 1, wherein the geometry of the first volume is different from the geometries of the second and third volume.

3. The electronic device of claim 1, wherein the geometry of the second volume is mirrored relative to the geometry of the third volume.

4. The electronic device of claim 1, wherein the antenna arrangement covers frequencies at or around at least four of the following frequency bands: 700 MHz, 850 MHz, 900 MHz, 1575 MHz, 1700 MHz, 1800 MHz, 1900 MHz, 2100 MHz, or 2400 MHz.

5. The electronic device of claim 1, wherein each of the first, second, and third volumes of the antenna arrangement includes the ungrounded portion of the printed circuit board within the housing.

6. The electronic device of claim 1, wherein each antenna structure is further shaped according to a peripheral shape of the housing interior.

7. The electronic device of claim 1, wherein the first antenna structure incorporates an inverted-L antenna.

8. The electronic device of claim 1, wherein the second antenna structure incorporates an inverted-L antenna.

9. The electronic device of claim 1, wherein the first antenna structure incorporates an inverted-F antenna.

10. The electronic device of claim 1, wherein the third antenna structure is configured to communicate within the 2400 MHz frequency band.

11. The electronic device of claim 1, wherein the antenna arrangement includes a fourth volume positioned adjacent to the third volume, the fourth volume enclosing a fourth antenna structure that is shaped substantially according to a geometry of the fourth volume.

12. The electronic device of claim 11, wherein the fourth antenna structure is configured to communicate within the 2400 MHz frequency band.

13. The electronic device of claim 12, wherein each of the first, second, third, and fourth antenna structures is configured to communicate with at least one wireless wide area network.

14. An antenna layout in an electronic device having a housing and a display, comprising:

a first antenna structure having a first shape and being positioned adjacent to a bottom of the display;

a second antenna structure, separate from the first antenna structure, having a second shape different from the first shape, the second antenna structure being positioned adjacent to a first corner of a top of the display; and a third antenna structure, separate from the first and second antenna structures, having a third shape that is mirrored relative to the second shape, the third antenna structure being positioned adjacent to a second corner of the top of the display, wherein the antenna structures can be configured to transmit and receive signals over a plurality of frequency bands, wherein at least one of the first volume, the second volume, and the third volume includes an ungrounded portion of a printed circuit board within the housing of the electronic device.

15. The antenna layout of claim 14, wherein the plurality of frequency bands includes at least three of the following Americas LTE frequency bands: 2, 3, 4, 5, 12, 13, 17, or 25.

16. The antenna layout of claim 14, wherein the first antenna structure is configured to transmit and receive signals over the 850 MHz and 1900 MHz frequency bands.

17. The antenna layout of claim 16, wherein the first antenna structure is further configured to transmit and receive signals over the 900 MHz and 1800 MHz frequency bands.

18. The antenna layout of claim 14, wherein the third antenna structure is configured to receive signals over the 1575 MHz frequency band.

19. The antenna layout of claim 18, wherein the third antenna structure is further configured to transmit and receive signals over the 2400 MHz frequency band.

20. The antenna layout of claim 14, wherein the antenna structures are disposed behind the display within the housing.

21. A method for arranging antennas in an electronic device with a housing comprising:

establishing a first volume without conductive elements adjacent to an edge of the housing;

establishing a second volume without conductive elements adjacent to a first corner of an opposing edge of the housing;

establishing a third volume without conductive elements adjacent to a second corner of the opposing edge of the housing;

placing a first antenna structure in the first volume, wherein the first antenna structure is configured to transmit and receive signals within frequency bands from 800 MHz to 1900 MHz;

placing a second antenna structure in the second volume, wherein the second antenna structure is configured to receive signals within frequency bands from 700 MHz to 2100 MHz; and placing a third antenna structure in the third volume, wherein the third antenna structure is configured to receive signals within frequency bands of 2100 MHz and greater, wherein at least one of the first volume, the second volume, and the third volume includes an ungrounded portion of a printed circuit board within the housing of the electronic device.

22. The method of claim 21, wherein the third antenna structure is also configured to transmit signals within frequency bands over 2100 MHz.

23. The method of claim 22, further comprising:

establishing a fourth volume without conductive elements adjacent to a lateral edge of the housing; and placing a fourth antenna structure in the fourth volume, wherein the fourth antenna structure is configured to transmit and receive signals with frequencies over 2000 MHz.

* * * * *